United States Patent [19]

Abtahi

[11] Patent Number: 4,884,627

[45] Date of Patent: Dec. 5, 1989

[54] OMNI-DIRECTIONAL HEAT PIPE

[76] Inventor: Amir Abtahi, 2649 NW. 28th Terr., Boca Raton, Fla. 33434

[21] Appl. No.: 211,868

[22] Filed: Jun. 27, 1988

[51] Int. Cl.[4] ..... F28D 15/02

[52] U.S. Cl. ..... 165/104.26; 165/104.33; 165/41; 122/366

[58] Field of Search ..... 165/104.26; 122/366

[56] References Cited

U.S. PATENT DOCUMENTS 4,040,478 8/1977 Pogson et al. ..... 165/104.26

FOREIGN PATENT DOCUMENTS 24366 2/1977 Japan ..... 165/104.26

848952 7/1981 U.S.S.R. ..... 165/104.26

*Primary Examiner*—Albert W. Davis, Jr.

*Attorney, Agent, or Firm*—John-Paul J. Violette

[57] ABSTRACT

An omni-directional heat pipe for cooling a local heat area, such as in electronic circuitry, including a sealed cavity for containment of multiple capillary-like coolant paths which may be inter-connectable or otherwise disposed in order to facilitate wide angle heat transfer dispersion. Said sealed cavity may be compressed as between said local heat areas and local cool areas. Said multiple capillary-like coolant paths comprising flexible tubing structured to permit ready flow of heat through evaporation at the hottest region, flow of the vapor to the cooler regions which is achieved as a result of inherently lower thermodynamic pressure, and the return of the condensate through a myriad of channels or capillaries acting as wick or surface tension induced flow, ready use as a thermal couple between respective high & low temperature regions.

14 Claims, 1 Drawing Sheet

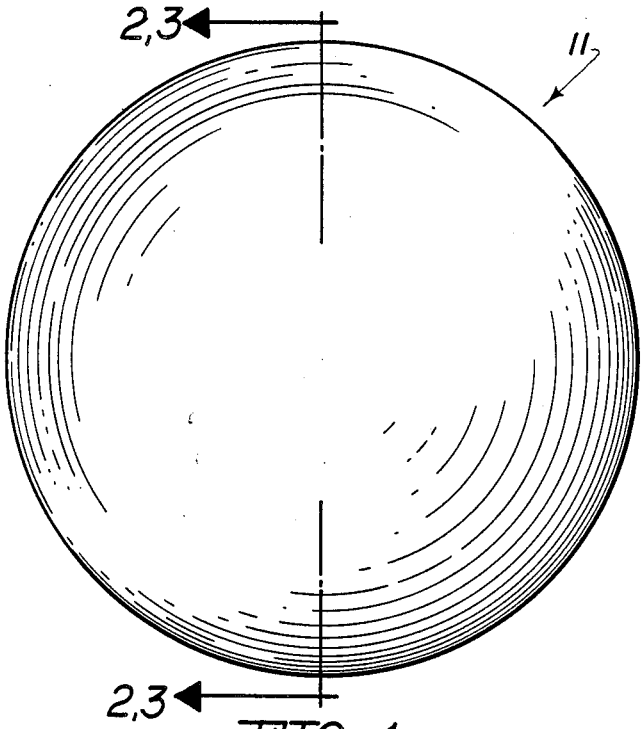
FIG. 1
FIG. 8
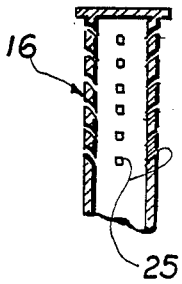
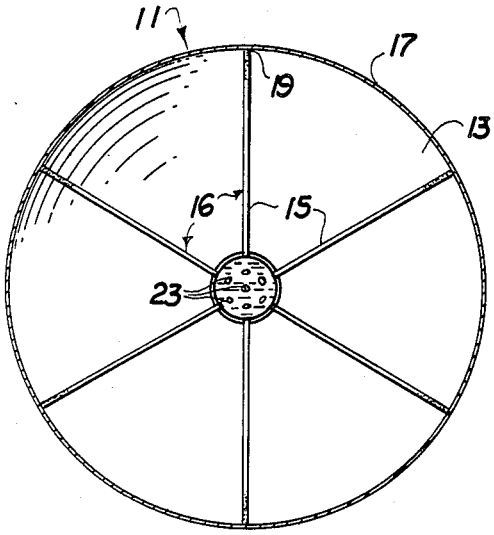
FIG. 2
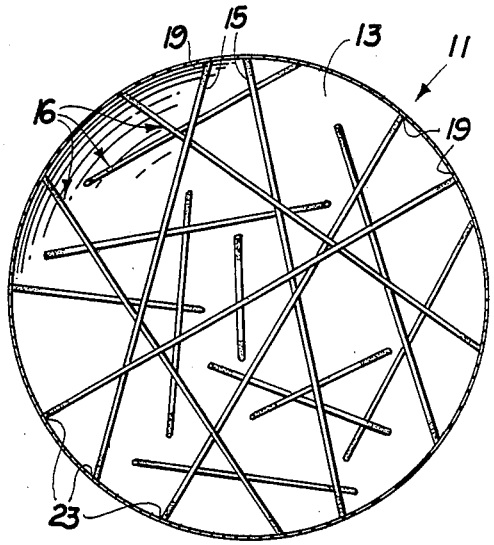
FIG. 3
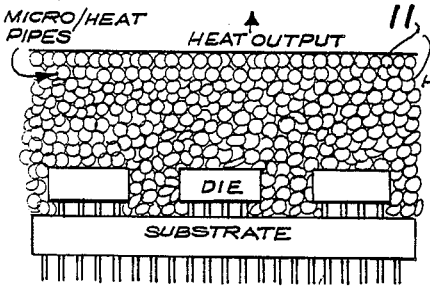
FIG. 5
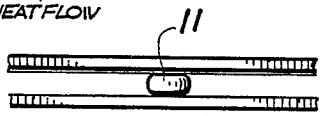
FIG. 4
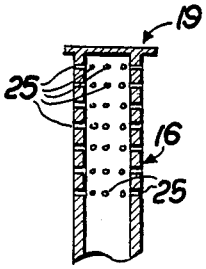
FIG. 6
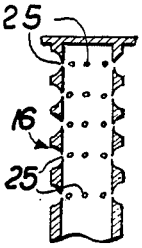
FIG. 7

OMNI-DIRECTIONAL HEAT PIPE

BACKGROUND OF THE INVENTION

1. Field of the Invention

This invention relates to a device for dissipating heat; and more particularly to a spherical heat pipe with a plurality of enclosed heat transfer paths containing a fluid, such as water, for thermally coupling through an evaporation-condensation cycle, an apparatus or assembly to be cooled by the coolest of multiple heat sinks in a particular region.

2. Description of the Prior Art

As is known in the art, a heat pipe is a device that can transport thermal energy very efficiently by relying on the evaporation, condensation and surface tension characteristics of the working fluid.The properly designed heat pipe is able to transfer several hundred times more heat per unit weight than is a solid thermal conductor of the same cross-sectional area. Briefly, it is a closed chamber lined with a pourous material or wick to provide a capillary structure. It contains a volatile fluid in sufficient quantity to saturate the porous lining or wick with little or no excess. The chamber may be of any shape. The operation of the heat pipe takes advantage of the latent heat of vaporization of the fluid. Heat applied to one portion of the wall evaporates the working fluid into the chamber. The vapor moves from the heated portion of the pipe to a cooler portion where it condenses to a liquid. The liquid is absorbed into the wick and, by capillary action, flows to the hot end of the chamber to replace the liquid being evaporated. Thus, the process is one of continuous pumping through a cycle of evaporation, liquid transport through the wick, and re-evaporation.

Previously, there have been a number of heat pipes for cooling mechanisms and apparatuses that have been developed. Those heat pipes have included predesigned paths formed by evaporation-condensation cycles for transferring heat. None of the prior art appears to reflect a flexible, re-shapeable heat pipe nor to reflect an omni-directional heat transfer capability. In addition and while the aforementioned devices are in common usage, it has also been recognized that in certain instances, such as with layers of micro-electronic circuitry, the regions of high heat development or pinpoint hotspots contain limited and varied space for coolant devices.

Accordingly, in order to overcome the above set forth problem of space & pinpoint hotspots as in microelectronic circuitry, there is a need for a simplified device which is structured to be versatile in its operation to the extent of being wedge-able into varied spaces & locations and capable of transferring heat in multiple directions away from potentially variable high heat sources.

In addition, prior problems of the prior art have included an inability to provide a heat pipe which could utilize alternative heat sinks, or if this problem was addressed, the solution was to provide only a limited switching capability by providing possibly a pair of heat pipes. A further limitation of these designs is that they do not usually involve the mixing of the fluid between alternative paths, so as to provide for channelling of portions of the heat to be transferred to multiple heat sinks.

SUMMARY OF THE INVENTION

The present invention is directed to an omni-directional heat pipe specifically designed to be used in combination with conventional coolants, such as water. In operation, the omni-directional heat pipe of the present invention is structured to permit ready flow of heat through evaporation at the hottest region, flow of the vapor to the coolant region which is achieved as a result of inherently lower thermodynamic pressure and the return of the condensate through a myriad of channels or capillaries acting as wick or surface tension induced flow; ready use as a thermal couple between respective high & low temperature regions; and, easy installation and variable sizing into cramped or high density areas as facilitated by a flexible shell & capacity system. The subject heat pipe enables easy maintenance and is inexpensive in design. The present invention overcomes or avoids the problems and limitations of the prior art by providing for a heat pipe assembly having multiple heat pipe paths which may be interconnected for free flow of heat in multiple directions simultaneously to maintain temperature equilibrium between various heat producing fixtures or componens within a localized region.

Accordingly, it is the principal object of this invention to provide an omni-directional heat pipe utilizing multiple, alternative fluid-filled capillaries for the return of the condensate regardless of the gravitational forces from hotspots to lower temperature regions.

A further object of the invention is to provide an omni-directional heat pipe that is compressible and useable in a compressed shape.

A further object of the invention is to provide an omni-directional heat pipe which is versatile and easily installed as by wedging between structures of varied shapes.

A further object of the invention is to provide an omni-directional heat pipe of simple & inexpensive construction.

BRIEF DESCRIPTION OF THE DRAWINGS

For a fuller understanding of the nature of the present invention including further aims and objects, reference should be had to the following detailed description taken in connnection with the accompanying drawings in which:

FIG. 1 is a perspective view of the preferred embodiment of the omni-directional heat pipe of the present invention wherein the natural shape of the invention is a spherical containment sealing the multiple pathed coolant capillaries within the skin.

FIG. 2 is a detailed side view in partial cutaway of the preferred embodiment of the omni-directional heat pipe showing the symmetrical capillary design with a central vessicle through which all of the capillary fluid is mixed.

FIG. 3 is a detailed side view in partial cutaway of an alternate embodiment of the omni-directional heat pipe of the present invention wherein the alternate capillary paths are separate from each other.

FIG. 4 is a side view of the omni-directional heat pipe showing one contemplated usage of the present invention wherein the shape of the heat pipe accomodates the proximate position between two fixtures.

FIG. 5 is a side view of the omni-directional heat pipe showing one contemplated usage of the present invention wherein multiple layers of said heat pipes are shown proximate a substrate.

FIG. 6 is a cross-sectional side view of the extremities of capillaries inside the omni-directional heat pipe showing three examples of coolant inlet/outlet orifices.

FIG. 7 is a cross-sectional side view of a second alternative design of the extremities of the capillaries inside the omni-directional heat pipe showing three examplex of coolant inlet/outlet orifices.

FIG. 8 is a cross-sectional side view of a third alternative design of the extremities of the capillaries inside the omni-directional heat pipe showing three examplex of coolant inlet/outlet orifices.

Like reference numerals refer to like parts throughout the several views of the drawings.

DETAILED DESCRIPTION OF THE PREFERRED EMBODIMENT

As shown in FIG. 1 through 8, the present invention is directed towards an omni-directional heat pipe, generally indicated by numeral 11, for cooling a local heat area, such as in electronic circuitry, including a sealed cavity 13 for containment of an array of capillary-like coolant paths 15 which are inter-connectable or communicative in order to facilitate wide angle heat dispersion from high temperature regions to low temperature regions.

The outer receptacle 17, inner receptacle 18, and capillaries 16 are preferably constructed of flexible (resilient), sealable material with a reasonably high thermal conductivity, such as some forms of plastics, flexible rubber, or very thin copper, aluminum or other metal which would not produce extraordinary deterioration or gases in conjunction with the capillary material and the working fluid which would degrade performance of the heat pipe. It is contemplated that the size of the omni-directional heat pipe may be reduced to miniature proportions on the order of millimeters in diameter where the miniaturization limitations are primarily a function of the presently available fabrication equipment. A wide range of plastics and molding and/or extruding techniques are known in the art which would be suitable for manufacture of the omni-directional heat pipe for the usage contemplated. Cf. Macmillan Engineering Evaluations, edited by John D. Beadle, The Macmillan Press Limited, 1971, Chapter 1.

The multiple capillary-like coolant paths 15 and inner cavity 21 of the inner receptacle 18 preferably carry substantially liquid working fluids, such as methanol, ammonia, or any of numerous other liquids from the fluoro-carbon class depending on operating temperature requirement, while the cavity 13 of the outer receptacle 17 houses the working fluid in substantially vapor form. With respect to the choice of the specific working fluid, its critical temperature must be higher than the operating temperature of the heat pipe to enable condensation to take place at the condenser section and the boiling of the fluid to take place at the evaporator section. The operating temperature must be higher than the triple point temperature of the working fluid to avoid the possible occurence of freezing. Furthermore, depending on the choice of fluid, the capillaries 16 and the orifices 25 must be sized small enough to provide adequate capillary action, but large enough to allow a sufficient flow rate of the condensed liquid to pass through them to accomplish the heat transfer objectives.

Referencing the preferred embodiment shown in FIG. 2, the omni-directional heat pipe 11 includes multiple capillaries 16 spaced between an outer receptacle 17 and an inner receptacle 18. The capillaries 16 may be fixed to, in substantially abutting relation, or relatively fixed in symmetric location and reference with respect to the inner skin of the outer receptacle 17 as by structure substantially maintaining reference of the outer reptacle 17 to the inner receptacle 18.

The capillaries 16 may or may not be sealed at the outer end 19, but will include arrays of orifices 25 permitting the flow of primarily vapor from the outer end 19 of capillaries 16 in a high skin temperature region of the outer receptacle 17 to the cavity 13 and permitting the flow of condensate from the cavity into the outer end 19 of capillaries 16 in a low skin temperature region of the outer receptacle 17. The working fluid travels within the capillaries 16 from the low temperature outer ends 19 to the innermost capillary ends 23 which open into the cavity 21 of the inner receptacle 18. The cavity 21 of the inner receptacle 18 operates as a mixing chamber for the fluid which flows toward the high temperature capillary ends 19 to replace the fluid lost to vaporization.

Referencing FIG. 3, an alternate embodiment is shown wherein the capillaries 16 do not inter-connect. Instead, each capillary 16 has a first and second end 19 and 23 which connect to the outer skin 17. Connecting may be accomplished by any of the standard techniques for anchoring and may include adhesion or molding or similar methods.

Referencing FIG. 4, the omni-directional heat pipe 11 is shown wedged between two structures.

Referencing FIG. 5, the omni-directional heat pipe 11 is shown in one contemplated usage of the present invention wherein multiple layers of said heat pipes are shown proximate a substrate. The heat from the substrate is transferred away by the multiple layering of heat pipes which may in turn be further dissipated by an external heat sink (not shown).

Referencing FIG. 6, 7, and 8 is a cross-sectional side view of the extremities 19 of the capillaries 16 inside the omni-directional heat pipe 11 showing three examples of coolant inlet/outlet orifices 25. The various forms & sizes of orifices 25 may be dictated by efficiency for condensation/evaporation considering the particular coolant characteristics including surface tension.

It is therefore to be understood that the following claims are intended to cover all of the generic and specific features of the present invention herein described, and all statements of the scope of the invention which as a matter of language, might be said to fall there between.

What is claimed is:

1. An omni-directional heat pipe comprising:
an outer receptacle including an outer skin, an inner skin, and a cavity;
an inner receptacle surrounded by said outer receptacle and including an innermost cavity; and,
a plurality of conduits located between said inner skin and said inner receptacle,
each of said plurality of conduits including a first end and a second end,
said first end in abutting relation with said inner skin,
said second end perforating said inner receptacle and opening into said innermost cavity; and,
means for transferring heat
including a working fluid substantially contained within said conduits.

2. An omni-directional heat pipe as in claim 1 said plurality of conduits including multiple perforations.

3. An omni-directional heat pipe as in claim 2, said multiple perforations being located at said first end of each of said plurality of conduits.

4. An omni-directional heat pipe as in claim 2, said multiple perforations being sized and proportioned to permit the escape of vapor and to permit the infusion of condensate.

5. An omni-directional heat pipe as in claim 1, said working fluid being substantially contained within said conduits and said innermost cavity as liquid and within said inner skin as vapor.

6. An omni-directional heat pipe as in claim 2 wherein said multiple perforations facilitating the escape of vapor of said working fluid from said plurality of conduits and into said cavity during evaporation, and, facilitating the flow of condensate from said cavity into said working fluid during condensation.

7. An omni-directional heat pipe assembly comprising:

a receptacle including an outer skin, an inner skin, and a cavity;

a plurality of conduits located within said cavity, each of said conduits including a first end and a second end, said first end and said second end in substantially abutting relation with said inner skin;

means for maintaining said first end and said second end in substantially abutting relation with said inner skin; and, means for transferring heat including a working fluid substantially contained within said conduits.

8. An omni-directional heat pipe as in claim 7, said plurality of conduits including multiple perforations 9. An omni-directional heat pipe as in claim 8, said multiple perforations being located at said first and said second end of each of said plurality of conduits.

10. An omni-directional heat pipe as in claim 7 wherein said multiple perforations enabling the escape of vapor of said working fluid from said plurality of conduits and into said cavity during evaporation, and, enabling the flow of condensate from said cavity into said working fluid during condensation.

11. An omni-directional heat pipe as in claim 7, said working fluid comprising at least one fluoro-carbon element.

12. An omni-directional heat pipe as in claim 8, said multiple perforations being sized and proportioned to permit the escape of vapor and to permit the infusion of condensate.

13. An omni-directional heat pipe as in claim 7, said working fluid comprising at least one fluoro-carbon element.

14. A method for utilizing the device as disclosed in either claim 1 or claim 7 including:

placing of multiple omni-directional heat pipes into a given space in the vicinity of at least one heat source for the purpose of transferring heat from said heat source.

* * * * *